US006974396B2

(12) United States Patent
Mauer et al.

(10) Patent No.: US 6,974,396 B2
(45) Date of Patent: Dec. 13, 2005

(54) BATTING AID DEVICE

(75) Inventors: Donald Mauer, St. Paul, MN (US); Gregory Knutson, St. Paul, MN (US); James Mauer, Minnetonka, MN (US)

(73) Assignee: Quickswing, Inc., St. Paul, MN (US)

( * ) Notice: Subject to any disclaimer, the term of this patent is extended or adjusted under 35 U.S.C. 154(b) by 0 days.

(21) Appl. No.: 10/341,536

(22) Filed: Jan. 13, 2003

(65) Prior Publication Data

US 2004/0087390 A1 May 6, 2004

Related U.S. Application Data

(60) Provisional application No. 60/347,359, filed on Jan. 11, 2002.

(51) Int. Cl.[7] ..... A63B 69/00; F41A 9/61; F41F 1/00

(52) U.S. Cl. ..... 473/417; 473/422; 473/451; 124/49; 124/48; 124/51.1

(58) Field of Search ..... 124/7, 83, 50, 124/51.1, 79; 473/417–419, 422, 451, 454, 429

(56) References Cited

U.S. PATENT DOCUMENTS 2,955,823 A * 10/1960 Chanko ..... 124/7
3,677,544 A * 7/1972 Meyers et al.
4,132,214 A * 1/1979 Schnurr et al. ..... 124/1
4,323,047 A * 4/1982 McIntosh et al.
4,538,810 A * 9/1985 Brophy
4,718,668 A * 1/1988 Schipske ..... 473/462
4,955,606 A * 9/1990 Leps ..... 124/50
5,042,802 A * 8/1991 Depianta ..... 124/50
5,066,010 A * 11/1991 Pingston
5,067,471 A * 11/1991 Kim
5,097,985 A * 3/1992 Jones ..... 124/48
5,294,109 A * 3/1994 Meade
D348,709 S * 7/1994 Leps ..... D21/720
D355,936 S * 2/1995 Boyd ..... D21/720
5,421,313 A * 6/1995 Strayer ..... 124/1
5,558,324 A * 9/1996 Jourdan ..... 124/83
6,223,358 B1 * 5/2001 DePietro ..... 473/466
6,296,581 B1 * 10/2001 Sever ..... 473/422

* cited by examiner

*Primary Examiner*—Mitra Aryanpour
(74) *Attorney, Agent, or Firm*—Dicke, Billig & Czaja, PLLC

(57) ABSTRACT

A batting aid is described. The batting aid includes a height-adjustable stand having top and bottom portions. A hollow tube having first and second ends is attached to the top portion of the stand. A mechanism is attached to the second end of the tube, and is adjustable to modify the exit angle of a ball placed in the device.

22 Claims, 6 Drawing Sheets

BATTING AID DEVICE

TECHNICAL FIELD

This application claims benefit of priority under 35 U.S.C. §119(e)(1) to U.S. provisional application Ser. No. 60/347,359, filed Jan. 11, 2002.

This invention relates to a device for improving swing speed and hand-eye coordination in the use of an instrument to strike an object, such as the use of a baseball bat or stick bat to hit a ball.

BACKGROUND

In sporting activities such as baseball and softball, which involve hitting a ball with a bat, the development of hand-eye coordination and swing speed are important to successfully and consistently hit the ball. Activities such as "soft toss" and devices such as batting tees are designed to improve hand-eye coordination and swing speed.

SUMMARY OF THE INVENTION

The invention features a batting aid device. The device includes a height-adjustable stand having a bottom portion and a top portion, a hollow tube attached to the top portion, the hollow tube having first and second open ends, and a rotatable mechanism attached to the second end. The rotatable mechanism is adjustable to modify the exit angle of a ball exiting the device. The device may further include two legs, wherein one of the legs is collapsible toward the other of the legs. Each of the legs may further comprise a foot extending generally perpendicularly from the bottom of the leg. Each of the feet may comprise telescoping sections. The stand may comprise a plurality of telescoping sections, wherein the telescoping sections include holes alignable at desired heights for the stand.

The tube can be adjustably rotatable about its attachment to the top portion of the stand and may include multiple sections or be a single piece. The tube can include an opening at a position along its length, between the first and second ends.

The rotatable mechanism may include a curved tube having open ends, and can further include a fitting adapted to be attached to the second end of the tube.

The attachment of the stand to the tube may include a dial knob to permit adjustment of the tube position.

The device may further include a ball holding apparatus, wherein the ball holding apparatus is adapted to engage with said tube and feed balls to the tube. The ball holding apparatus may include a bucket and a plate within the bucket, the plate having a top and bottom and having at least one opening sized to allow a ball to pass therethrough. The plate preferably includes wheels on its bottom and tabs on its top for positioning balls on the plate. The ball holding apparatus may further include a motor operatively connected to the plate for rotating the plate.

In a preferred embodiment, the second end of the tube includes a circumferentially recessed groove about at least a portion of the circumference of the tube, wherein the circumferential groove includes a plurality of spaced-apart raised portions within the groove. In this embodiment, the rotatable mechanism includes two open ends, further includes ring and end portions, wherein an inner surface of the ring portion has at least one detent for engaging with the recessed groove and the raised portions in the circumferential groove. The ring portion may optionally include at least one generally "U" shaped slot, wherein the detent or detents are positioned on a portion of the inner surface surrounded by said "U" shaped slot to provide a snapping portion for snapping the mechanism into the groove.

In another preferred embodiment, the second end of the tube includes a plurality of holes arranged circumferentially about the second end of the tube. In this embodiment, the rotatable mechanism includes two open ends, and ring and end portions, wherein the ring portion includes at least one spring loading pin protruding from an inner surface of the ring portion for engaging with the holes in the second end of the tube. In a preferred embodiment, the ring portion has two spring loading pins. The rotatable mechanism may alternatively include two pieces, wherein a ring portion piece is attached to an end portion piece by one or more pivot pins.

In another aspect, the invention features a batting aid device including a height-adjustable stand having a bottom portion and a top portion, a hollow tube attached to the top portion, the hollow tube having first and second open ends, and a rotatable mechanism attached to the second end, the rotatable mechanism rotatably adjustable to distinct index points, wherein each index point corresponds to a desired exit angle for a ball exiting the device.

The advantages of the invention are apparent from the description and claims that follow.

DESCRIPTION

Figure 1A:
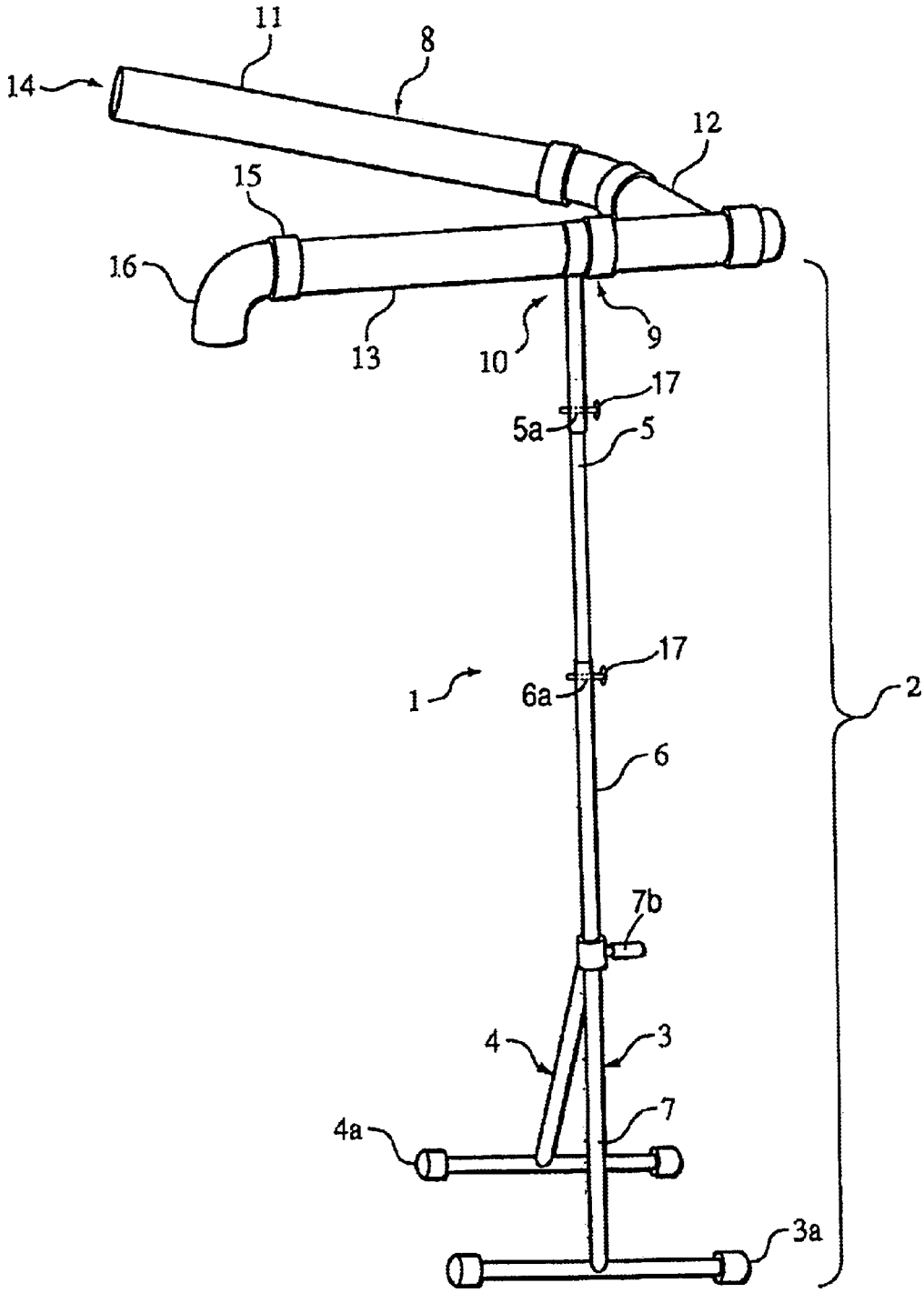
FIG. 1A shows a perspective view of an embodiment of the invention.

The invention relates to an improved batting aid device. The device can be used by right-handed or left-handed hitters, and be operated individually or with a partner. The device is designed to improve hand-eye coordination, reflexes, muscle memory, and timing in hitting a ball with a bat, and to develop a quicker, more compact swing. In preferred embodiments, the device is adjustable to allow increasing or decreasing levels of difficulty, is adjustable to different heights, and is foldable for easy storage and transport.

In general, the device includes a stand having a bottom portion and a top portion and a plastic tube attached to the top portion. A ball, for example a baseball, wiffle baseball, or wiffle golf ball can be placed in the tube at a first end of the tube or at a position along the tube. The tube is positioned such that the ball will travel by gravity to a second end of the tube and exit the tube at a selected exit angle, e.g. straight downward, 45 degrees, etc. Preferably the tube is opaque so as to prevent the user from visualizing the ball as it travels in the tube.

As the ball exits the end of the tube, the user can visualize the ball and attempt to hit it with a bat, stick or the like.

In preferred embodiments, the stand of the device includes two legs at the bottom portion wherein one leg is collapsible, and further preferably includes multiple telescoping sections. The multiple telescoping sections allow the device to be adjusted to different heights to accommodate the stature of the user. In one embodiment, the stand includes two legs with one leg collapsible, and three telescoping sections that allow the device to be adjusted between twenty-four inches tall and sixty-six inches tall. A stand with the foregoing features has the additional advantage of being folded and compacted to fit within a small space such as the trunk of an automobile. All elements of the device can be fabricated from any desired material. The stand, for example, may be fabricated from metal to add weight and stability to the device, or may be fabricated from plastic to provide a more lightweight device, e.g. for small children to use. The hollow tube and rotatable mechanism are preferable fabricated from plastic or other lightweight material to prevent the device from being top heavy. The tube can be a single piece or have multiple sections as desired for versatility or compact storage. Preferably the tube and rotatable mechanism are fabricated from injection-molded plastic.

The tube may be attached to the top portion of the stand using any suitable means, for example a metal ring or clamp adapted to tightly fit around the tube and be attached to the top portion of the stand, preferably in conjunction with an adjustable dial or knob used to connect the ring holding the tube to the stand. The plastic tube may be "L" shaped, or preferably as a generally sideways "V" and include multiple sections that allow for disassembly or multiple adjustments. In a sideways "V" configuration, a user can load the device with a ball at the first end of the plastic tube (the upper end of the sideways "V", and remain in position to hit the ball as it exits the second end of the tube (the lower end of the sideways "V". The plastic tube may also be a single, molded tube. The means of attachment of the tube to the stand may further include a knob to adjust the plastic tube such that a ball placed in the tube travels downward toward the second end of the tube by the force of gravity. The plastic tube may further include, at its second end, a mechanism that allows adjustment of the exit path for the ball. The mechanism may include, for example, a curved section of plastic tubing that may be fitted, via a fitting designed to slide onto the second end of the tube, allowing adjustment of the angle of exit of the ball. Such adjustability is particularly advantageous for altering the degree of difficulty in hitting the ball exiting the tube, with a straight vertical downward path providing a higher degree of difficulty than, for example, a horizontal or angled path.

FIG. 1A depicts a device according to the invention, as described above. The device 1 includes a stand 2, wherein the stand includes two legs 3 and 4. Leg 4 is collapsible toward leg 3. Legs 3 and 4 may further include, feet 3*a* and 4*a*, as shown in FIG. 1*a*. Legs 3*a* and 4*a* extend perpendicularly from the legs 3 and 4 at, the base of legs 3 and 4. In one embodiment, feet 3*a* and 4*a* include telescoping sections that allow the feet to be extended and provide further stability to the device during use, and allow the device to be more compact when stored or transported. The stand further includes telescoping sections 5, 6, and 7. In the embodiment shown in FIG. 1*a*, hollow plastic tube 8 is attached, at attachment 9, to a top portion 10 of stand 2. The hollow tube 8 is preferably adjustably rotatable about attachment 9. Plastic tube 8 includes 1 three sections 11, 12, and 13. The plastic tube 8 has a first open end 14 and a second open end 15. A mechanism 16 for altering the exit path of a ball is shown in FIG. 1 a as a curved piece of plastic tubing. The curved piece of tubing is open at its two ends; one end includes a fitting 19 adapted to be attached to second end 15 of plastic tube 8. In this embodiment, the rotatable mechanism is infinitely adjustable to provide the exit angle, by simply rotating the mechanism as it engages with the second end of the tube.

Figure 1B:
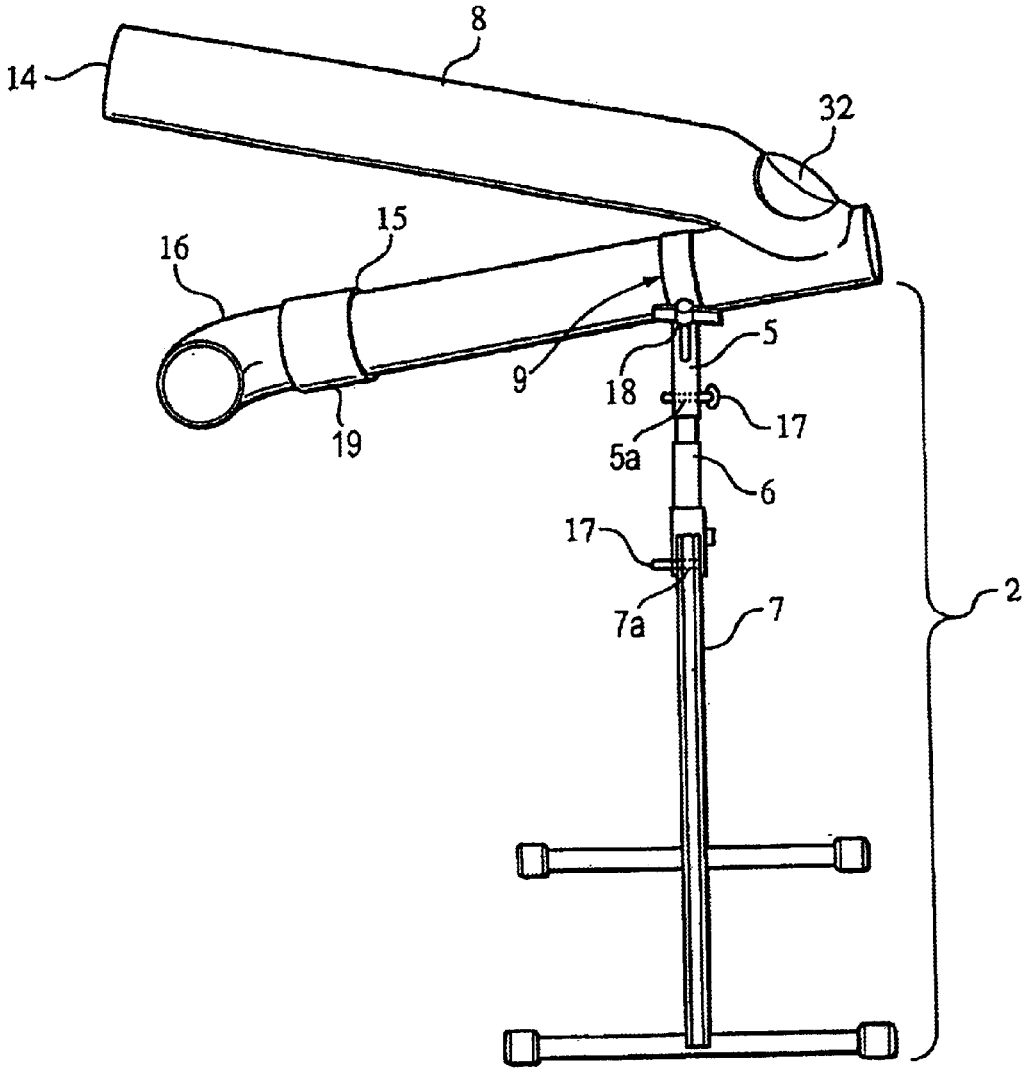
FIG. 1B shows a perspective view of another embodiment of the invention.

FIG. 1B shows another embodiment of the invention and illustrates additional features of the improved batting device Telescoping sections 5, 6, and 7 of the stand 2 can be adjusted to a preferred height by the use of pins 17 placed through aligned holes 5*a*, 6*a*, 7*a* in the interlocking sections 5, 6, and 7. Further, adjustment mechanism 7*b* allows for the adjusting of telescoping section 6 relative to telescoping section 7. In one embodiment, adjustment mechanism 7*b* is a tightening mechanism. In addition, FIG. 1*b* shows a dial 18 at the attachment 9 of the stand 2 to the tube 8, which allows the tube 8 to be adjustably rotated such that a ball placed in the tube will travel by force of gravity. FIG. 1B also shows the optional feature of an opening 32 in the tube 8. The opening can be positioned at any desired point in the length of the tube. Opening 32 provides an alternative position for feeding balls into the device, for example for a partner to stand clear of the user while loading the device, as well as an alternative position to place a ball holding device such as that depicted in FIGS. 2A and 2B.

Figure 2A:
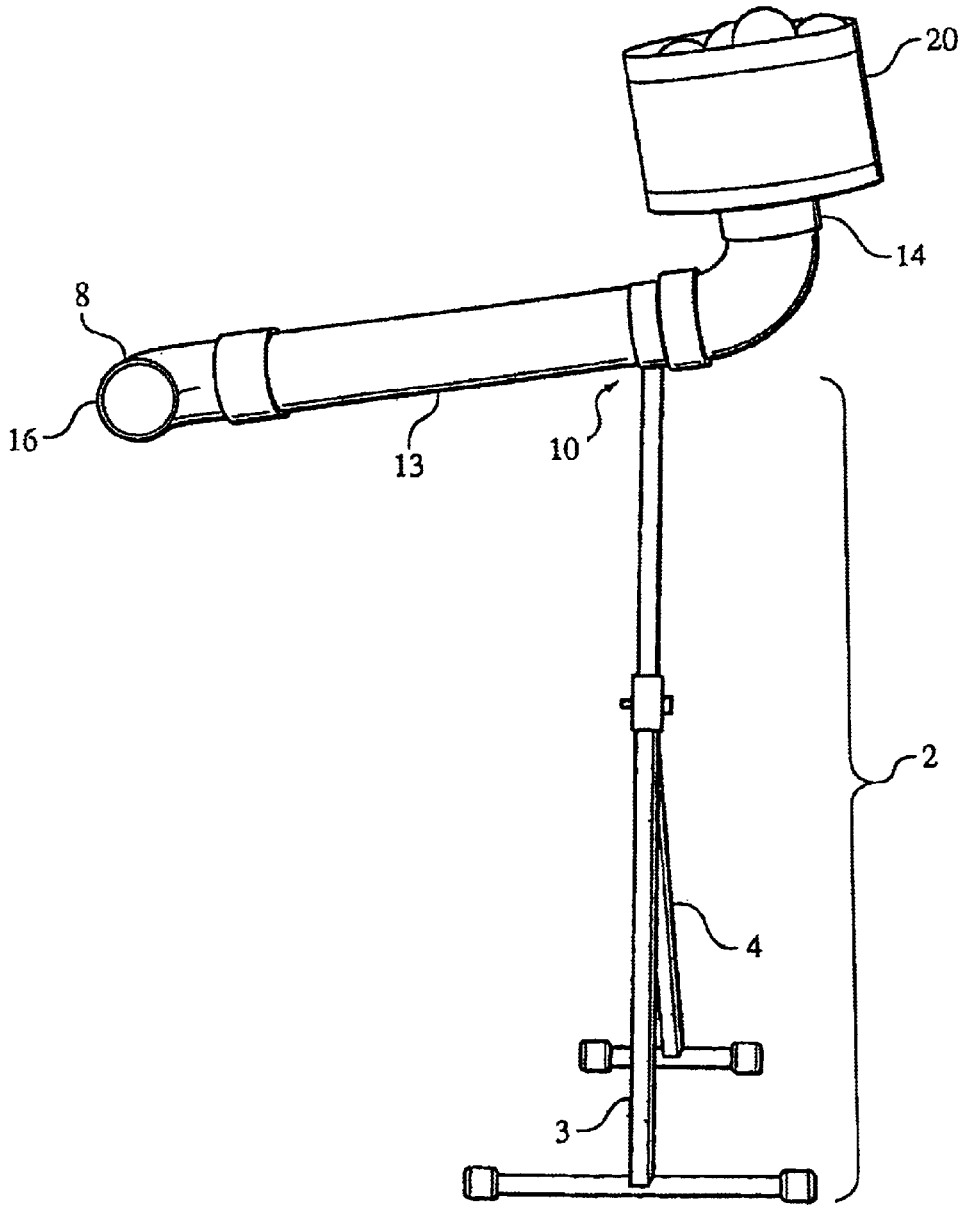
FIG. 2A shows a perspective view of an embodiment of the present invention illustrating a ball holding apparatus.
Figure 2B:
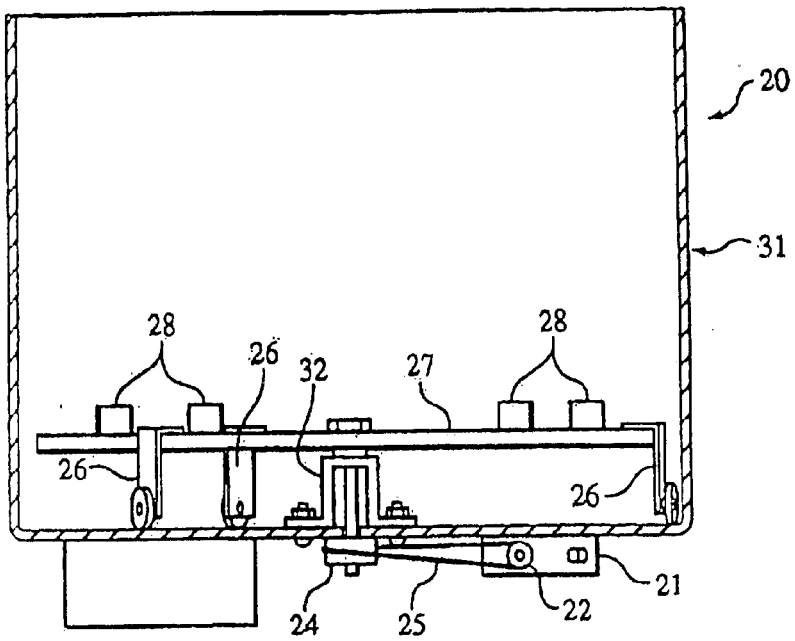
FIG. 2B and FIG. 2C shows side and top views of an illustrative ball holding apparatus in accordance with the invention.

FIGS. 2A and 2B depict another preferred embodiment of the device. The device shown in FIG. 2A includes a stand 2 similar to that shown in FIG. 1. The device of FIG. 2A also contains a plastic tube 13 attached to a top portion of the stand. The device of FIG. 2A includes the additional feature of a ball holding apparatus 20 attached at a distal end of the plastic tube 13. The ball holding apparatus is capable of holding many balls, and may be attached at any desired position along the length of the tube. The ball holding apparatus allows a user to continuously hit one ball after the other after it exits the tube without having to manually load single balls. The ball holding device may be automated to feed balls to the device, or may be a receptacle to store multiple balls for manual loading.

Figure 2C:
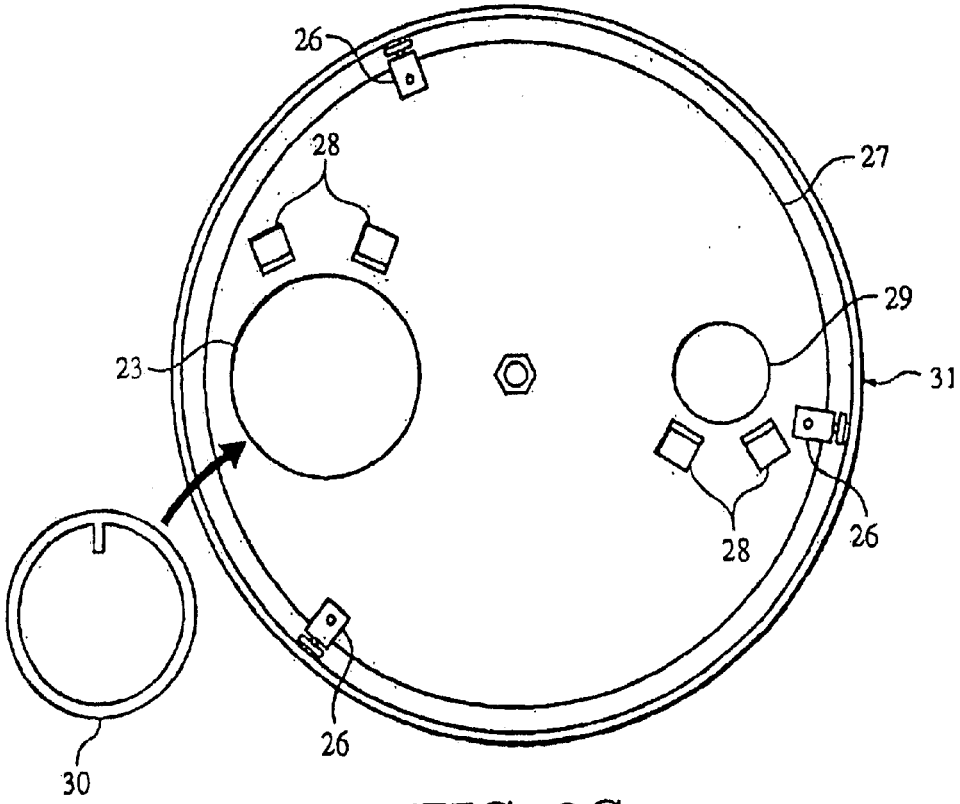

A ball holding apparatus in accordance with the invention is depicted in FIG. 2B and FIG. 2C in side and top views. The elements of the ball holding apparatus are shown in detail in FIG. 2B.

In general, the ball holding apparatus 20 includes a plastic bucket 31 containing a plate 27 (plate 27 preferably being metal). Bucket 31 has an opening in its bottom to allow balls to pass through into the tube, and is adapted to fit onto tube 8, e.g. by a collar or other fitting designed to mate with an opening in the tube 8. A motor 21 (preferably battery operated) that turns plate 27 (by pulleys 22 and 24 and rubber belt 25) and is designed to drop a ball out of the apparatus at a time interval, e.g. about every ten seconds, through a hole 23 in the plate sized to permit passage of a ball of desired diameter. A vertical pulley 22 on the motor is connected to a horizontal pulley 24 on the partially threaded stud by rubber belt 25. The rubber belt 25 may be designed to slip to prevent injury resulting from placing a finger or hand into the moving apparatus. The apparatus includes "L" tab with wheels 26 to keep the metal plate 27 balanced and easy to turn. Tabs 28 on the metal plate are designed to drop a ball into a hole and prevent jamming of the balls. The plate may advantageously include multiple holes 23 and 29 sized to generally fit the size of the balls being used in the device, for example three inches for baseball-sized balls and one and a half inches for wiffle golf balls. This feature allows the device to be adaptable for use with differently sized balls. A three-inch cap 30 may be used to plug a three-inch hole 23 when golf ball sized balls are used in the device. A "U" shaped steel bracket 32 may be included, and is designed to allow a ball to partially drop down in the hole, and thereby prevent the ball from easily popping out of a hole.

Figure 3A:
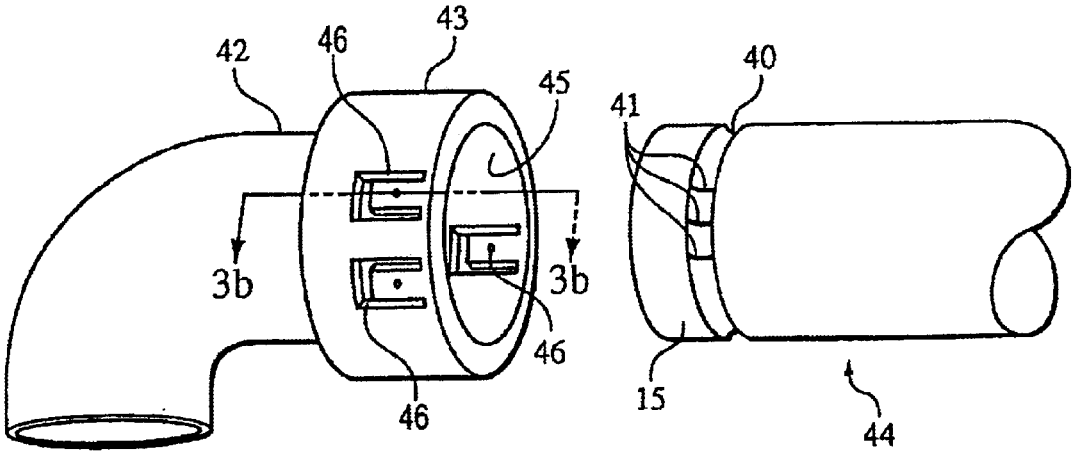
FIG. 3A shows a perspective view of one embodiment of a rotatable mechanism in accordance with the invention.
Figure 3B:
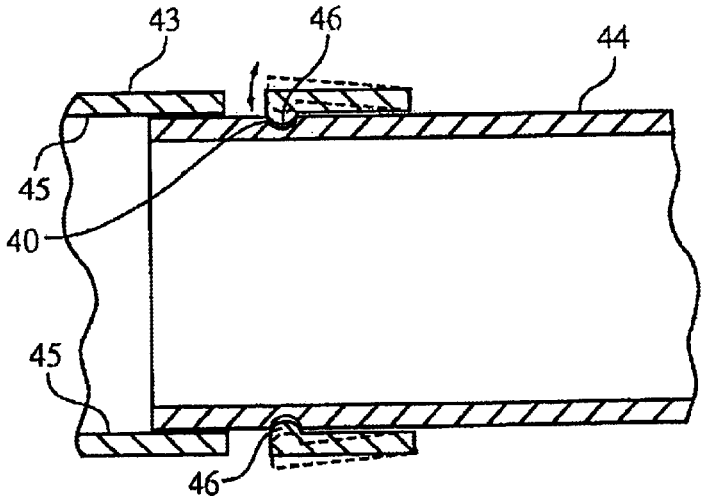
FIG. 3B shows a longitudinal cross section of the embodiment depicted in FIG. 3A.

Additional embodiments of the invention feature alternatives to the mechanism 16 for altering the exit path of the ball. FIGS. 3*a* and 3*b* illustrate one such alternative. In this embodiment of the device, the second end 15 of the tube has a circumferential recessed groove 40 about at least a portion, preferably the entirety, of the circumference of the tube near second end 15, wherein the recessed groove contains a plurality of raised portions spaced apart at selected intervals within the groove 40. Rotatable mechanism 42 contains a ring portion 43 for mating with second end 15, and dial tube 44, which is the exit point for a ball. Ring portion has an inner surface 45, and one or more detents 46 on the inner surface 45. As shown in FIG. 3*a*, the ring 43 contains a plurality of generally "U" shaped slots 47, with detents 46 on the inner surface 45 surrounded by the "U" to provide a snapping portion of the ring portion for snapping into the groove. This configuration allows mechanism 43 to snap onto second end 15, by positioning the detent 46 into the groove 40. This snapping action is illustrated in FIG. 3*b*. Once the mechanism 42 is snapped onto the second end 15, the mechanism can be indexed to a desired distinct position by rotating the mechanism to snap out of and into index positions defined by raised portions 41, thus allowing for adjustment of the exit angle of a ball emerging from second end 15 through the mechanism 42.

Figure 4A:
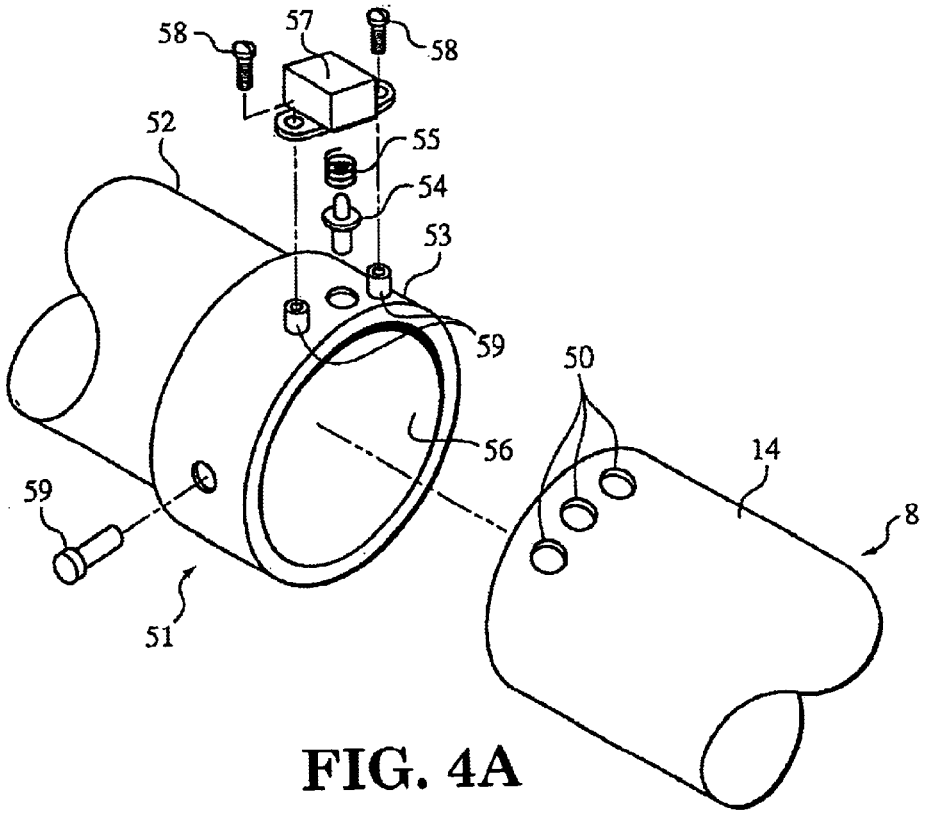
FIG. 4A shows a perspective and partially exploded view of an embodiment of a rotatable mechanism in accordance with the invention.
Figure 4B:
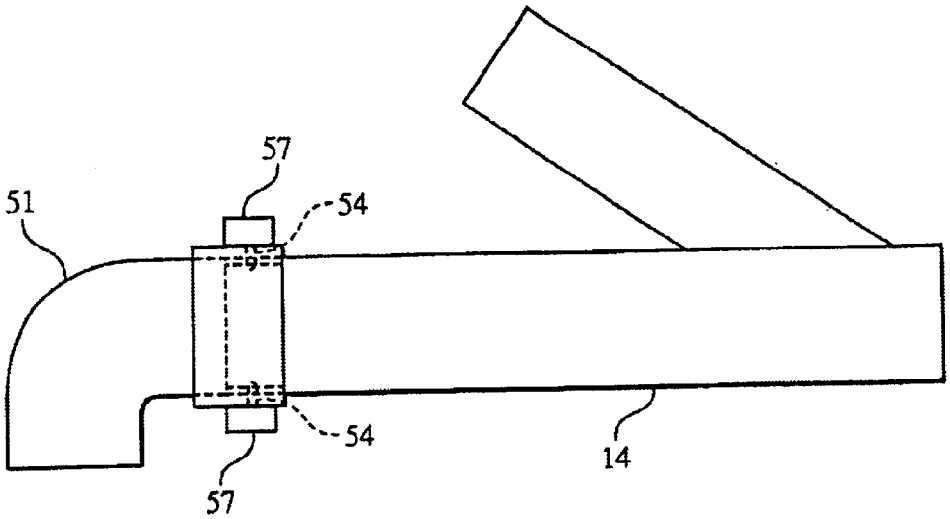
FIG. 4B shows a perspective view of the embodiment depicted in FIG. 4A. Like reference numerals refer to like elements.

FIGS. 4*a* and 4*b* illustrate another alternative for the mechanism for altering the exit path of the ball. In this embodiment, second end 15 of the device contains a plurality of holes 50 arranged and spaced apart circumferentially near the second end 15 of the tube 8. Rotatable mechanism 51 contains a dial end portion 52 and a ring portion 53, and at least one spring loading pin 54 and spring 55 (shown in exploded view in FIG. 4*a*), wherein the spring loading pin is adapted to be fastened to the ring portion 53. The spring loading pin 54 extends through and protrudes from the inner surface 56 of the ring portion 53, and is adapted to engage with the holes 50 in second tube end 15 with the ring portion 53 is placed over the second end 15. The spring loading pin 54 is further adapted to move out of and into holes 50 as the mechanism 51 is rotated to index the mechanism at a desired position that will provide a desired exit path for a ball emerging from the mechanism 51. In the embodiment shown in FIG. 4*a*, a housing 57 covers the spring loading pin 54 and spring 55 and is attached with screws 58 to the ring portion 53. In the embodiment shown in FIG. 4*b*, there are two spring loading pins 54 in the mechanism 51. As shown in FIG. 4*a*, the mechanism 51 may be comprised of separate ring 53 and dial end portion 52, with the ring 53 attached to the dial end portion 52 by one or more pivot pins 59. In this embodiment, the device would be assembled by attaching the ring 53 (containing the spring loading pin(s) 54 for indexing) to the dial end 52 by engaging the pivot pin(s) 59 with holes in the ring 53. The mechanism 51 comprising the dial end 52 and ring 53 is then placed over the first end 14 of the tube 8 such that the spring loading pin(s) 54 engage with holes 50. The mechanism 51 can then be rotated and locked into desired distinct positions for determining the exit path of the ball.

The devices of the invention preferably are used in conjunction with a stepwise hitting process to develop hand-eye coordination and a quicker swing for hitting a baseball or softball. In general, a stepwise hitting process may include steps in which parameters of the process are varied. Parameters of the process that may be varied include the type of instrument (baseball bat, stick bat), the size of the ball (baseball-size, golf ball size), and the exit path of the ball (substantially directly toward the user, e.g. a generally horizontal exit path; at an angle, e.g. 45 degrees; and substantially straight down or vertical). In general, the method involves increasing the degree of difficulty of hitting the ball with each step, by varying at least one parameter of the process, with the end result being improvement in hand-eye coordination and swing speed. For example, a first step may include using a baseball bat to hit wiffle baseballs as the balls come toward the user; a second step could include using a stick bat to hit wiffle baseballs coming toward the user; a third step and fourth step could repeat the first step and second step using wiffle golf balls. These four steps can then be repeated with the ball exiting the device at a forty-five degree angle, and repeated again with the ball dropping straight down.

An example of a twelve step hitting process that can be used in conjunction with the device of the invention is as follows:

Step 1. Use a baseball bat to hit wiffle baseballs as the balls come toward you.

Step 2. Use a stick bat to hit wiffle baseballs as the balls come toward you.

Step 3. Use a baseball bat to hit wiffle golf balls as the balls come toward you.

Step 4. Use a stick bat to hit wiffle golf balls as the balls come toward you.

Step 5. Use a baseball bat to hit wiffle baseballs as the balls come at 45-degree angle.

Step 6. Use a stick bat to hit wiffle baseballs as the balls come at 45-degree angle.

Step 7. Use a baseball bat to hit wiffle golf balls as the balls come at 45-degree angle.

Step 8. Use a stick bat to hit wiffle golf balls as the balls come at 45-degree angle.

Step 9. Use a baseball bat to hit wiffle baseballs as the balls drop straight down.

Step 10. Use a stick bat to hit wiffle baseballs as the balls drop straight down.

Step 11. Use a baseball bat to hit wiffle golf balls as the balls drop straight down.

Step 12. Use a stick bat to hit wiffle golf balls as the balls drop straight down.

Other embodiments of the invention are within the scope of the appended claims.

What is claimed is:

1. A batting aid device, comprising:

a height-adjustable stand having a bottom portion and a top portion;

a hollow tube attached to said top portion, said hollow tube having first and second open ends;

a rotatable mechanism attached to said second end, said rotatable mechanism adjustable to modify the exit angle of a ball exiting said device; and wherein said device further includes a ball holding apparatus, said ball holding apparatus adapted to engage with said tube and feed balls to said tube; and further wherein said ball holding apparatus comprises a bucket and a plate within said bucket, said plate having a top and bottom and comprising at least one opening sized to allow a ball to pass therethrough, said plate comprising wheels on said bottom and tabs on said top.

2. The device of claim 1, wherein said bottom portion of said stand comprises two legs, and wherein one of said legs is collapsible toward die other of said legs.

3. The device of claim 2, wherein each of said legs further comprises a foot extending generally perpendicularly from said leg.

4. The device of claim 3, wherein each of said feet comprises telescoping sections.

5. The device of claim 1, wherein said stand comprises a plurality of telescoping sections, wherein said telescoping sections include holes alignable at desired heights for said stand.

6. The device of claim 1, wherein said tube is adjustably rotatable via an attachment mechanism to said top portion of said stand.

7. The device of claim 1, wherein said tube comprises multiple sections.

8. The device of claim 1, wherein said tube comprises a single piece and is shaped substantially as a sideways "V" when attached to the stand for use.

9. The device of claim 1, wherein said tube comprises an opening at a position along its length, between said first and second ends.

10. The device of claim 1, wherein said mechanism comprises a curved tube having open ends, and further comprises a fitting adapted to be attached to said second end of said tube.

11. The device of claim 6, wherein said attachment includes an adjustable dial knob.

12. The device of claim 1, wherein said ball holding apparatus further comprises a motor operatively connected to said plate for rotating said plate.

13. The device of claim 1, wherein said second end of said tube comprises a circumferentially recessed groove about at least a portion of the circumference of said tube, and wherein said circumferential groove comprises a plurality of spaced-apart raised portions within said groove.

14. The device of claim 13, wherein said mechanism comprises two open ends, further comprises ring and end portions, and wherein an inner surface of said ring portion comprises at least one detent for engaging with said recessed groove and said raised portions in said circumferential groove.

15. The device of claim 14, wherein said ring portion comprises at least one generally "U" shaped slot, wherein said detent or detents are positioned on a portion of said inner surface surrounded by said "U" shaped slot to provide a snapping portion for snapping said mechanism into said groove.

16. The device of claim 1, wherein said second end comprises a plurality of holes arranged circumferentially about said second end of said tube.

17. The device of claim 16, wherein said mechanism comprises two open ends, and ring and end portions.

18. The device of claim 17, wherein said ring portion comprises at least one spring and a spring loading pin protruding from an inner surface of said ring portion for engaging with said holes in said second end of said tube.

19. The device of claim 18, wherein said ring portion comprises two spring loading pins.

20. The device of claim 17, wherein said mechanism comprises two pieces, wherein a ring portion piece is attached to an end portion piece by one or more pivot pins.

21. The device of claim 1, wherein said hollow tube is opaque.

22. A batting aid device, comprising:

a height-adjustable stand having a bottom portion and a top portion;

a hollow tube attached to said top portion, said hollow tube having first and second open ends;

a rotatable mechanism is attached to said second end, said rotatable mechanism rotatably adjustable to distinct index points, wherein each said index point corresponds to a desired exit angle for a ball exiting said device; and wherein said device further includes a ball holding apparatus, said ball holding apparatus adapted to engage with said tube and feed balls to said tube; and further wherein said ball holding apparatus comprises a bucket and a plate within said bucket, said plate having a top and bottom and comprising at least one opening sized to allow a ball to pass therethrough, said plate comprising wheels on said bottom and tabs on said top.

* * * * *